US005155410A

United States Patent [19]

Wakasono et al.

[11] Patent Number: 5,155,410

[45] Date of Patent: Oct. 13, 1992

[54] SHADOW MASK TYPE COLOR CATHODE RAY TUBE

[75] Inventors: Hiromi Wakasono, Yao; Osamu Adachi, Osaka; Osamu Konosu, Nagaokakyo; Shigeya Ashizaki, Takatsuki, all of Japan

[73] Assignee: Matsushita Electric Industrial Co., Ltd., Japan

[21] Appl. No.: 668,598

[22] Filed: Mar. 13, 1991

[30] Foreign Application Priority Data

Mar. 22, 1990 [JP] Japan ..... 2-73041

[51] Int. Cl.[5] ..... H01J 29/80; H01J 29/10

[52] U.S. Cl. ..... 313/402; 313/408; 313/461; 313/477 R; 220/2.1 A

[58] Field of Search ..... 313/402, 408, 477 R, 313/461; 220/2.1 A

[56] References Cited

U.S. PATENT DOCUMENTS

| | | | |
|---|---|---|---|
| 4,570,101 | 2/1986 | Campbell | 313/461 |
| 4,777,401 | 10/1988 | Hosokoshi et al. | 313/461 |
| 4,786,840 | 11/1988 | Ragland, Jr. | 313/477 R |
| 4,839,556 | 6/1989 | Ragland, jr. | 313/477 R |
| 4,985,658 | 1/1991 | Canevazzi | 313/477 R |

FOREIGN PATENT DOCUMENTS

| | | |
|---|---|---|
| 0283129 | 9/1988 | European Pat. Off. . |
| 62-177841 | 8/1987 | Japan . |

*Primary Examiner*—Donald J. Yusko
*Assistant Examiner*—Diab Hamadi
*Attorney, Agent, or Firm*—Ratner & Prestia

[57] ABSTRACT

A shadow mask type color cathode ray tube which has a face panel whose screen face is flattened to more than two times the flatness of the conventional flat panels without reducing the resistance of the glass bulb to outside pressure in spite of its relatively thin glass wall, and has an enhanced reflection characteristic of incident light as well as improved local doming characteristics.

3 Claims, 4 Drawing Sheets

SHADOW MASK TYPE COLOR CATHODE RAY TUBE

BACKGROUND OF THE INVENTION

1. Field of the Invention

The present invention relates generally to a shadow mask type color cathode ray tube, and more particularly to a shadow mask type color cathode ray tube equipped with a rectangular face panel whose screen has a flattened exterior surface.

2. Description of the Prior Art

When the exterior surface of a screen of a face panel is spherical, the exterior surface gives a more spherical appearance in a large-size color cathode ray tube than in a small-size color cathode ray tube. Thus, a large-size color cathode ray tube has an unnatural appearance in regeneration of pictures. In addition, the reflection of incident light upon the spherical exterior surface is likely to reduce the contrast in brightness in the regeneration picture. In the case of a large-size color cathode ray tube, a wide angle of deflection of at least 110° is required so as to minimize its depth and weight.

In principle, the useful screen of a face panel has an equivalent radius of curvature determined on the basis of the diagonal diameter of the useful screen. Referring to FIG. 5, a rectangular face panel 1 has a screen including a useful screen 2. The center of it is defined as the origin 0, and a horizontal axis passing through the origin 0 and orthogonal to the tube axis z is defined as the X-axis, a vertical axis passing through the origin 0 and orthogonal to the tube axis is defined as the Y-axis. In this way an orthogonal coordinate system is formulated. By using this orthogonal coordinate system, the diagonal diameter of the useful screen 2 is defined as D, and the sagittal height from the origin 0 up to the diagonal radius (D/2) in the z direction is defined as δ. The equivalent radius of curvature $R_0$ of the useful screen 2 of the face panel 1 is expressed as follows:

$$Ro = \frac{(D/2)^2 + \delta^2}{2\delta}. \quad (1)$$

Face panels that have an equivalent radius of curvature of about 1.76 times the diagonal diameter D of the useful screen 2, are generally called "1R panels", and face panels having a greater equivalent radius of curvature than those of the 1R panels are called "flat panels".

The shadow mask 3 of a wide angle deflection color cathode ray tube equipped with a flat panel partly domes toward the outside owing to thermal expansion; in FIG. 6, the doming part is indicated by 3*a*. Such a phenomenon is called "local doming". When it occurs, an aperture 3*c* of the shadow mask 3 is caused to displace from its proper position 3*c* to a "false" position 3*b* as shown in FIG. 6. An electron beam 5*a* is compelled to reach a phosphor portion 4*b*, instead of a phosphor portion 4*a*, through the aperture 3*b* displaced to the "false" position as a "false" electron beam 5*b*. If no local doming occurs, the electron beam 5*a* would reach the phosphor portion 4*a* through the aperture 3*c* as designed. The deflection of the electron beam 5*a* spoils the purity of color.

In order to achieve a flat screen exterior surface in large-size cathode-ray tubes, a thick glass bulb must be used so as to withstand atmospheric pressure after evacuation, thereby increasing its weight.

Even if the face panel has a spherical screen surface and if the peripheral portion is rather flat, the screen surface gives a flat appearance as a whole. The cathode ray tube disclosed in U.S. Pat. No. 4,786,840 takes advantage of this phenomenon. Specifically, this prior art cathode ray tube has a flattened peripheral portion, and the portion extending from the center to the periphery of the useful screen, which is most susceptible to local doming, has especially increased curvature.

Under the last-mentioned prior art cathode ray tube, a sagittal height occurs between the center and the peripheral portion. This causes the inversion of the symbols of quadratic differentials of the spherical surfaces in the diagonal direction, thereby causing a saddle-like bowing, commonly called "inverted bowing". The increase in the curvatures from the center to the periphery along the X axis and Y axis, and the inverted bowing jointly affect the reflection of incident light upon the useful screen of the face panel, thereby producing unnatural reflection. With an image, particularly a moving object, the speed of motion gives an unnatural appearance in an area where the change of curvature is large.

In order to solve this problem, other prior art disclosed in Japanese Laid-Open Patent Publication No. 62-177841 (U.S. Pat. No. 4,777,401) proposes that the peripheral portion is flattened from 1.5R to 1.8R (i.e. an equivalent radius of curvature of 1.5 to 1.8 times the equivalent radius of curvature of 1R), and that the portions of the useful screen of the face panel that extend from the center to the diagonal ends have an equivalent radius of curvature ranging from 1.3R to 1.5R. As a whole, this spherical portion is effectively flattened.

This proposal is advantageous in that the inverted bowing is prevented from occurring in the peripheral portion, thereby ensuring that this portion is non-spherical without having any point of inflection. Another advantage is that the glass bulb can be thin, almost equal to the thickness of a conventional 1R panel, thereby reducing the weight of the face panel. In addition, the reflection of incident light upon the useful screen of the face panel becomes natural, and the movement of electron beams is minimized at the occurrence of local doming. Owing to these merits, the proposed face panel is applied to large-size color cathode ray tubes such as 29-inch, 33-inch, and 43-inch cathode ray tubes.

However, the proposal described above is disadvantageous in that since the curvature is gradually diminished toward the periphery of the screen, no additional flattening is permissible even if that be desirable. In the last-mentioned proposal the peripheral portion can be flattened to the degree of 1.3R to 1.5R but when the size of the face panel is increased, the flattened portion nevertheless has an spherical appearance.

SUMMARY OF THE INVENTION

The shadow mask type color cathode ray tube of this invention, which overcomes the above-discussed and numerous other disadvantages and deficiencies of the prior art, comprises a rectangular face panel having a exterior surface which is defined by an orthogonal coordinate system formulated by defining the center of the exterior surface as the origin O, a horizontal axis passing through the origin O and orthogonal to the tube axis Z as the axis X, a vertical axis passing through the origin O and orthogonal to the tube axis Z as the axis Y, so as to establish that in the coordinates (x, y, z) of a given point P, z is expressed by a polynomial function of the x and y wherein the sum of the quadratic or less power terms is $\delta_1$, and the sum of more than quadratic power terms is $\delta_2$, these sums satisfying the relationship $\delta_1 > \delta_2$, and the useful screen satisfies the following relationships:

$$5 < \frac{(D/2)^2 + z_C^2}{D \cdot z_C} < 9$$

$$7 < \frac{y_C^2 + (z_C - z_A)^2}{D \cdot (z_C - z_A)} < 13$$

$$7 < \frac{x_C^2 + (z_C - z_B)^2}{D \cdot (z_C - z_B)} < 13$$

wherein the coordinate (H/2, O, $z_A$) designates a point A on the axis X in the peripheral portion of the exterior surface the coordinate (O, V/2, $z_B$) designates point B on the axis Y in the peripheral portion of the exterior surface, and the coordinate ($x_C$, $y_C$, $z_C$) designates a point C on the diagonal axis in the peripheral portion of the exterior surface, and the diagonal diameter of the useful screen is defined as D.

In a preferred embodiment, the color cathode ray tube is a 29-inch color cathode ray tube.

Thus, the invention described herein makes possible the objectives of providing a shadow mask type color cathode ray tube capable (1) of withstanding pressure in spite of a relatively thin glass bulb, (2) of enhancing the reflection characteristic of incident light, and (3) of restraining the occurrence of local doming.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
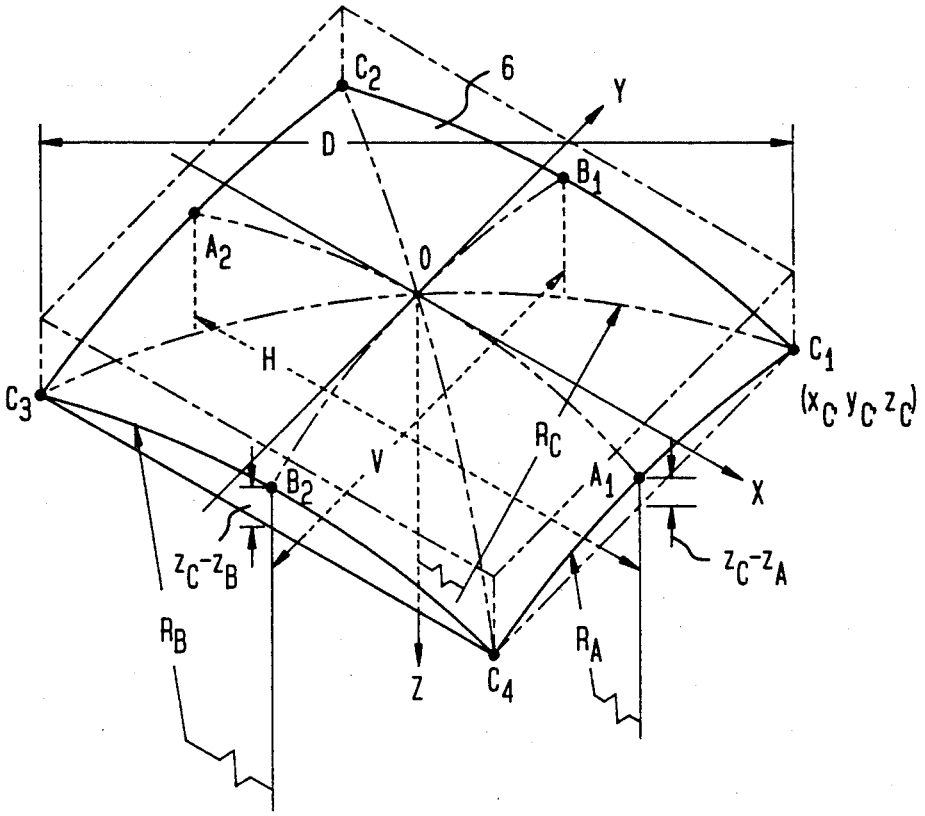
FIG. 1 is a perspective view showing a face panel used in a shadow mask type color cathode ray tube according to the present invention.

Referring to FIG. 1, the illustrated rectangular face panel 6 is for a 29-inch color cathode ray tube, having a component x in the major axis direction (x axis), a component y in the minor axis direction (y axis), and a component z in the axial direction Z of the cathode ray tube. The sagittal height from the origin O (the center of the exterior surface of the face panel 6) in the Z direction is defined as z (mm) which is expressed by:

$$z = \alpha_1 x^2 + \alpha_2 y^2 + \alpha_3 x^4 + \alpha_4 x^2 y^2 + \alpha_5 y^4 + \alpha_6 x^4 y^2 + \alpha_7 x^2 y^4 + \alpha_8 x^4 y^4 \quad (2)$$

and $$\begin{aligned} \alpha_1 &= 2.09216 \times 10^{-4}\ \text{1/mm} \\ \alpha_2 &= 2.97318 \times 10^{-4}\ \text{1/mm} \\ \alpha_3 &= 7.15356 \times 10^{-10}\ \text{1/mm}^3 \\ \alpha_4 &= -1.71561 \times 10^{-9}\ \text{1/mm}^3 \\ \alpha_5 &= 1.80728 \times 10^{-9}\ \text{1/mm}^3 \\ \alpha_6 &= -1.31622 \times 10^{-14}\ \text{1/mm}^5 \\ \alpha_7 &= -1.71957 \times 10^{-14}\ \text{1/mm}^5 \\ \alpha_8 &= -1.85522 \times 10^{-20}\ \text{1/mm}^7 \end{aligned} \quad (3)$$

Based upon the relationships (2) and (3), it is derived as follows:

The diagonal diameter D of the useful screen is equal to 676.0 mm, and the minimum useful screen diameters H in the X axis and V in the Y axis are equal to 540.8 mm and 405.6 mm, respectively. The sagittal height zc in the Z direction between the origin O and the diagonal end of the useful screen is equal to 24.0589 mm. The equivalent radius of curvature Rc is 2386.3 mm. 1R is equal to 1.76D (=1189.8 mm). Thus, the normalized radius of curvature becomes 2R.

In the minor sides $C_1$ to $C_4$ and $C_2$ to $C_3$, each sagittal height $x_A$ between the origin 0 and point $A_1$, and between the origin 0 and point $A_2$ is equal to 19.1214 mm, and the sagittal height $\delta$ ($Z_c$–$Z_a$) from the diagonal end is 4.9375 mm. The equivalent radius of curvature $R_A$ of the minor side amounts to 4167.3 when 4.9375 mm for $\delta$ and 202.8 mm for r are put in the equation (1). The normalized radius of curvature becomes about 3.5R.

In the major sides $C_1$ to $C_2$ and $C_3$ to $C_4$, each sagittal height $x_B$ between the origin 0 and point $B_1$, and between the origin 0 and point $B_2$ is equal to 15.2854 mm, and the sagittal height $\delta$ ($Z_c$–$Z_b$) from the diagonal end is 8.7739 mm. The equivalent radius of curvature $R_B$ of the major side amounts to 4171.1 when 8.7739 mm for $\delta$ and 270.4 mm for r are put in the equation (1). The normalized radius of curvature becomes about 3.5R. The radii of curvature on the X axis and the Y axis passing through the origin O become 1.6R and 1.1R, respectively. It will be appreciated that the increase in the radius of curvature is minimized, and the occurrence of doming is restrained.

Figure 2:
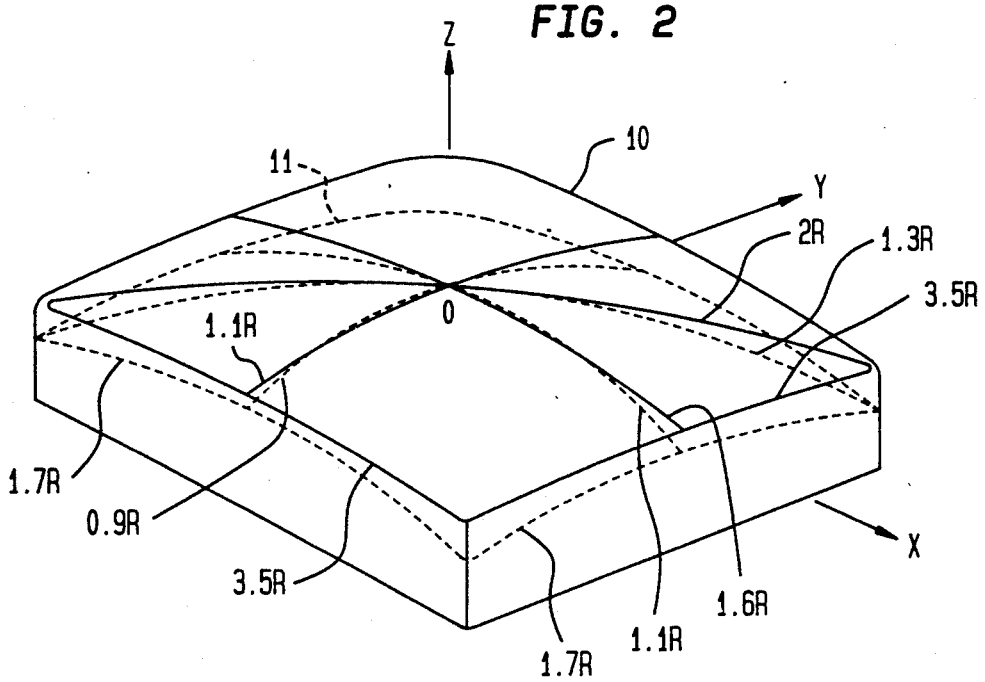
FIG. 2 is a perspective view showing the comparison between the face panel of FIG. 1 and the conventional flat panel.
Figure 3:
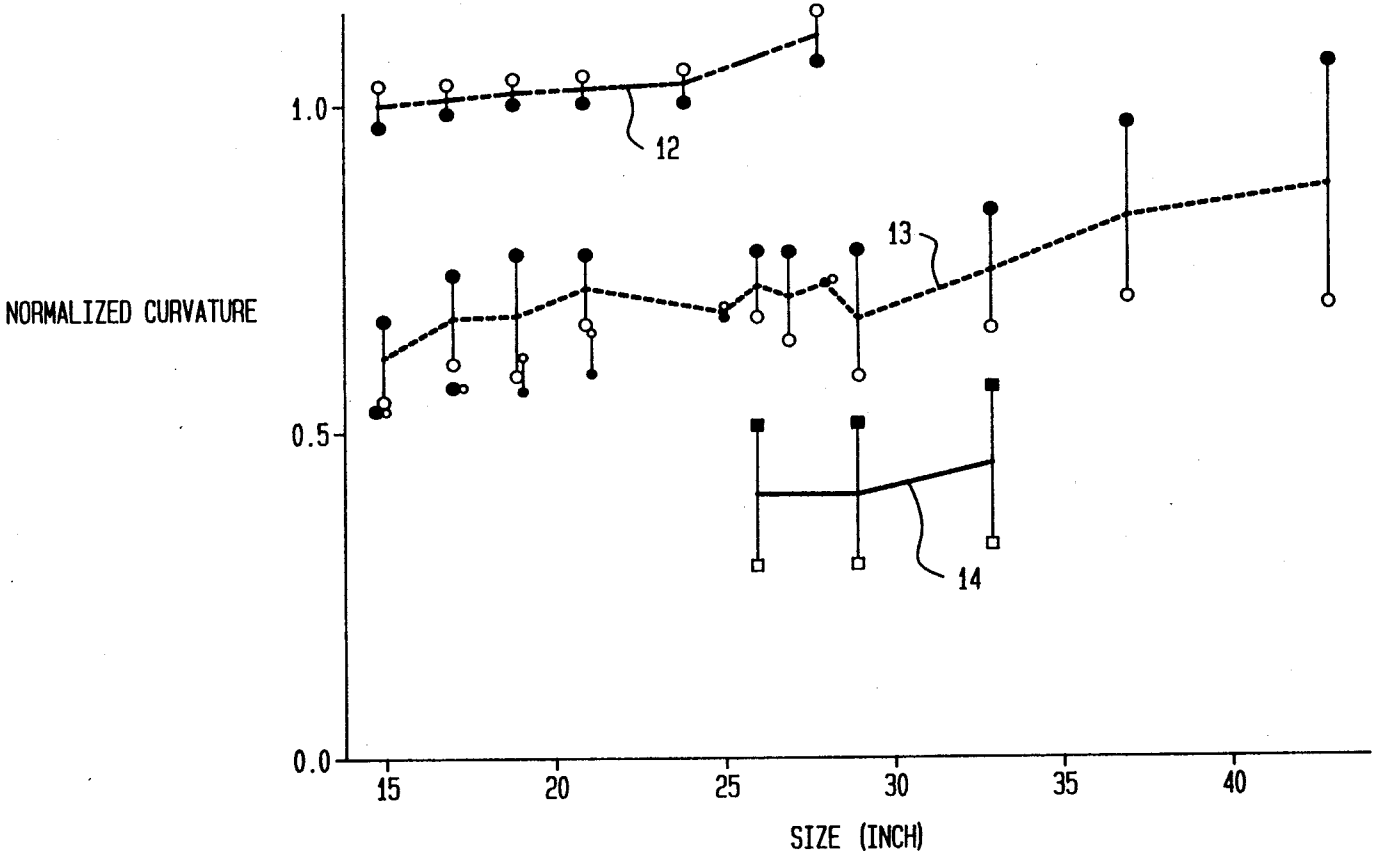
FIG. 3 is a view showing graphs plotted by normalized radii of curvature of the face panel of FIG. 1 and the conventional face panel.

In FIG. 2, the flat panel 10 used under the present invention is indicated by full lines, and the flat panel 11 used under the conventional cathode ray tube is indicated by dotted lines so as to make clear comparison therebetween. FIG. 3 contains graphs plotted by the normalized curvatures (the inverse number of the normalized equivalent radius of curvature) of the face panel 12 of the conventional 1R, the conventional flat panel 13 and the face panel 14 of the present invention. It will be appreciated from the graphs that the face panel 14 of the present invention becomes about two times flatter than the conventional face panel.

When evacuation is achieved in the color cathode ray tube, stress is concentrated on the center of the peripheral portions of the face panel. The major sides are most susceptible to stress. The stress is virtually proportional to the radius of curvature of the face panel. In the case of a 29-inch color cathode ray tube to which the present invention is applied, it was arranged that the radius of curvature were 1.1R on the Y axis and 1.6R on the X axis, almost equal to those of the conventional face panel. Thus, the stress acting on the outside surface was reduced to 1300 PSI or less. A test by the hydrostatic pressure, that is, an abrasion test was conducted by cutting the outside surface by means of a file having a roughness of 150 count. The test revealed that the outside surface endured a pressure of 2.8 $Kg/cm^2$ to 3.0 $Kg/cm^2$.

The studies described above have proved that the face panel of the present invention is applicable to practical use if the equivalent radius of curvature from the origin 0 to the point C is in the range from 1.5R to 2.5R, and the equivalent radii of curvature of the peripheral portions passing through points A, B and C are in the range from 2R to 3.7R. If the flattening exceeds this limit, a sufficiently thick glass must be prepared so as to be applicable to practical use.

In the diagonal axis, the relationship can be expressed by:

$$1.5R = 1.5 \times 1.76D \approx 2.5D$$

$$2.5R = 2.5 \times 1.76D \approx 4.5D$$

Herein, $2.5D < R_O < 4.5D$ $$\delta = Z_c$$

Therefore, $$2.5D < \frac{(D/2)^2 + z_C^2}{2z_C} < 4.5D \quad (4)$$

$$5 < \frac{(D/2)^2 + z_C^2}{D \cdot z_C} < 9$$

In the minor sides $$2R = 2 \times 1.76D \approx 3.5D$$

$$3.7R = 3.7 \times 1.76D \approx 6.5D$$

$$3.5D < R_o < 6.5D$$

$$\delta = z_C - z_A$$

Therefore, $$3.5D < \frac{y_C^2 + (z_C - z_A)^2}{2(z_C - z_A)} < 6.5D \quad (5)$$

$$7D < \frac{y_C^2 + (z_C - z_A)^2}{z_C - z_A} < 13D$$

Likewise, in the major sides $$7D < \frac{x_C^2 + (z_C - z_B)^2}{z_C - z_B} < 13D \quad (6)$$

In conclusion, it is essential in the present invention to arrange so that the following equations are simultaneously satisfied:

$$5 < \frac{(D/2)^2 + z_C^2}{D \cdot z_C} < 9 \quad (7)$$

$$7 < \frac{y_C^2 + (z_C - z_A)^2}{D \cdot (z_C - z_A)} < 13$$

$$7 < \frac{x_C^2 + (z_C - z_B)^2}{D \cdot (z_C - z_B)} < 13$$

Under the arrangement mentioned above, it is necessary to examine the characteristic of the spherical surface so as to enhance the reflection of incident light. It is therefore required to arrange so that the sum of sagittal heights of power terms of greater than quadratic order do not exceed that of sagittal heights of power terms of quadratic order or less.

Figure 4A:
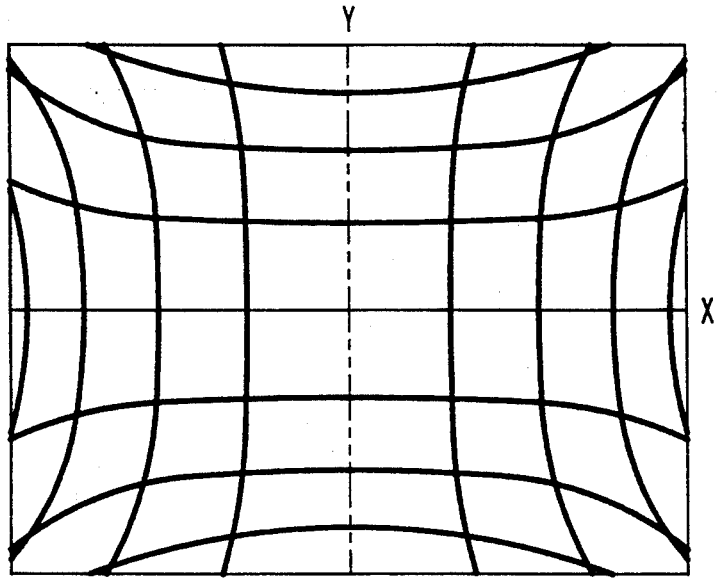
FIGS. 4(*a*) and (*b*) are views showing the comparison between the reflection characteristics of incident light upon the face panels in a color cathode ray tube of the present invention and a color cathode ray tube lacking one of the requirements required by the present invention.
Figure 4B:
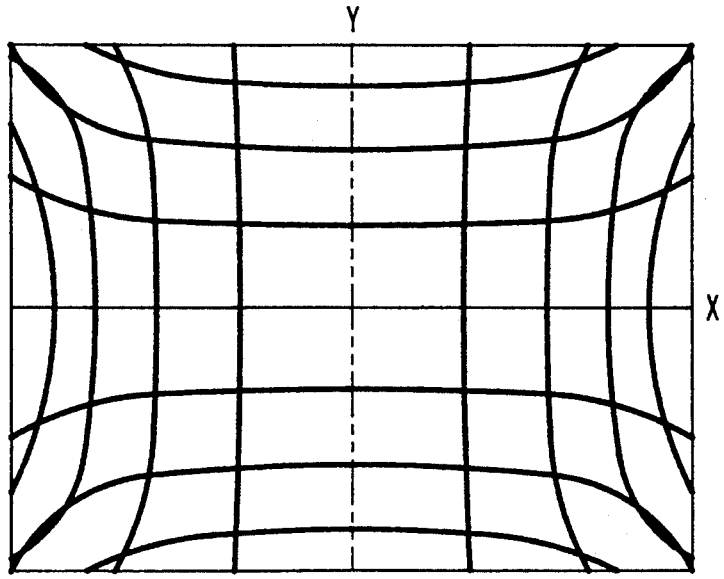
Figure 5:
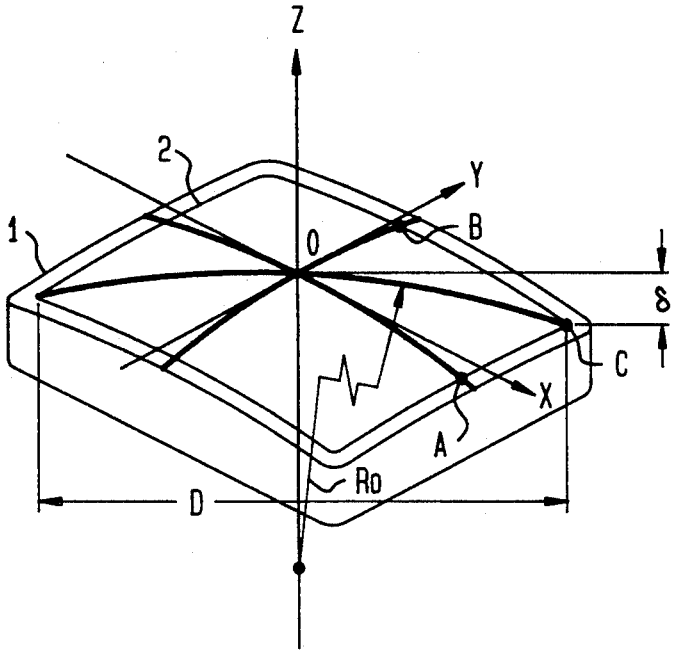
FIG. 5 (PRIOR ART)
FIG. 5 is a perspective view of a conventional face panel.
Figure 6:
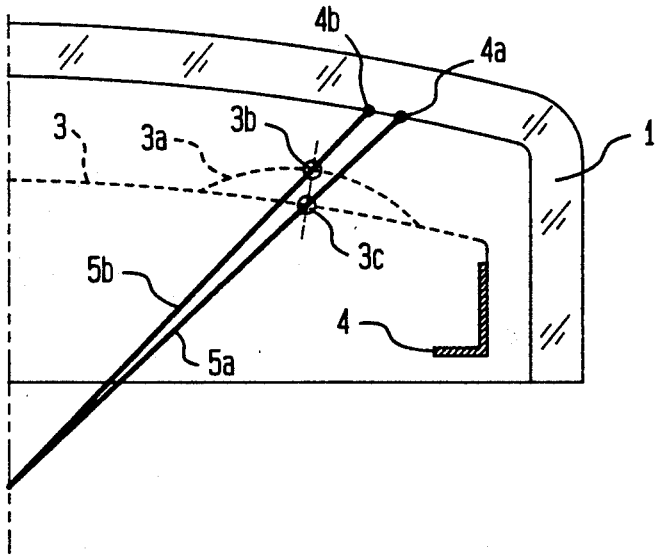
FIG. 6 (PRIOR ART)
FIG. 6 is a cross-sectional side view exemplifying a doming phenomenon occurring in a shadow mask.

FIG. 4(*a*) shows an example of the reflection characteristic of incident light upon the exterior surface of the face panel of a 29-inch color cathode ray tube. FIG. 4(*b*) shows an example of the reflection characteristic of incident light upon the exterior surface of the face panel of a conventional 29-inch color cathode ray tube in which the equivalent radius of curvature along the diagonal diameter and the radius of curvature of the peripheral portions are made equal as in the present invention (defined by the same equation as the equation (2)) so as to equalize the sagittal height of the quadratic power terms and that of the quartic power terms. The grate-like patterns in FIGS. 4(*a*) and 4(*b*) show images reflected from the respective face panel for a grated plate in 30 cm pitch which is placed 2 m distant from the front of the respective face panel.

In the embodiment illustrated in FIG. 4(*a*) the quartic power terms in the equations (2) and (3) is smaller than the quadratic power terms. The reflection of incident light is susceptible to gradual distortion from the center to the diagonal ends of the screen, particularly in an area outside 85% of the effective area of the screen but the influence of it upon the reflected pattern is negligible. In contrast, in the example illustrated in FIG. 4(*b*), the reflection of incident light is fatally distorted under the influence of sagittal height of the quartic power term outside $\frac{2}{3}$ of the distance from the center to the peripheral portions of the screen.

As is evident from the foregoing description, according to the present invention a color cathode ray tube can be equipped with a face panel flattened to more than two times the flatness of the conventional flat panels without reducing the resistance of the glass bulb to outside pressure. In addition, the reflection characteristic of incident light is enhanced, and the local doming characteristic is also improved.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A shadow mask type color cathode ray tube comprising a rectangular face panel having an exterior surface which has a useful screen area, where the exterior surface is defined by an orthogonal coordinate system formulated by defining the center of the exterior surface as the origin O, a horizontal axis passing through the origin O and orthogonal to a tube axis Z as the axis X, a vertical axis passing through the origin O and orthogonal to the tube axis z as the axis Y, so as to establish that in the coordinates (x, y, z) of a given point P, z is expressed by a polynomial function of x and y wherein the sum of the quadratic or less power terms is δ1, and the sum of more than quadratic power terms is δ2, these sums satisfying the relationship $\delta 1 > \delta 2$, and the exterior surface satisfies the following relationships:

$$5 < \frac{(D/2)^2 + z_C^2}{D \cdot z_C} < 9$$

$$7 < \frac{y_C^2 + (z_C - z_A)^2}{D \cdot (z_C - z_A)} < 13$$

$$7 < \frac{x_C^2 + (z_C - z_B)^2}{D \cdot (z_C - z_B)} < 13$$

wherein a coordinates (H/2, O, $z_A$) designate a point A on the axis X in a peripheral portion of the useful screen area, coordinates (O, V/2, $z_B$) designate a point B on the axis Y in the peripheral portion of the useful screen area, and coordinates ($x_C$, $y_C$, $z_C$) designate a point C on the diagonal axis in the peripheral portion of the useful screen area, and the diagonal diameter of the useful screen area is defined as D, the vertical diameter along the axis Y of the useful screen area is defined as V, and the horizontal diameter along the axis X of the useful screen area is defined as H.

2. A shadow mask type color cathode ray tube as defined in claim 1, wherein the color cathode ray tube is a 29-inch color cathode ray tube.

3. A shadow mask type color cathode ray tube comprising a rectangular face panel having an exterior surface which has a useful screen area, where the exterior surface is defined by an orthogonal coordinate system formulated by defining the center of the exterior surface as the origin O, a horizontal axis passing through the origin O and orthogonal to a tube axis Z as the axis X, a vertical axis passing through the origin O and orthogonal to the tube axis Z as the axis Y, so as to establish that for coordinates (x, y, z) corresponding to a given point P, z is expressed by a polynomial function of x and y wherein the sum of each term whose power is two or less of said function is $\delta_1$, and the sum of each term whose power is more than two of said function is $\delta_2$, these sums satisfying the relationship $\delta_1 > \delta_2$, and the exterior surface satisfies the following relationships:

$$5 < \frac{(D/2)^2 + z_C^2}{D \cdot z_C} < 9$$

$$7 < \frac{y_C^2 + (z_C - z_A)^2}{D \cdot (z_C - z_A)} < 13$$

$$7 < \frac{x_C^2 + (z_C - z_B)^2}{D \cdot (z_C - z_B)} < 13$$

wherein coordinates (H/2, O, $z_A$) designate a point A on a minor side of the useful screen area, coordinates (O, V/2, $z_B$) designate a point B on a major side of the useful screen area, and coordinates ($x_C$, $y_C$, $z_C$) designate a point C on corner formed by said minor side and said major side of the useful screen area, and the diagonal diameter of the useful screen area is defined as D, the vertical diameter along the axis Y of the useful screen area is defined as V, and the horizontal diameter along the axis X of the useful screen area is defined as H.

* * * * *